US011122954B2

(12) United States Patent
Ding et al.

(10) Patent No.: US 11,122,954 B2
(45) **Date of Patent: *Sep. 21, 2021**

(54) MOTORIZED FLOOR MOP

(71) Applicant: BISSELL Homecare, Inc., Grand Rapids, MI (US)

(72) Inventors: Junfeng Ding, Guangzhou (CN); Jianjun Ge, Guangzhou (CN); Alan J. Krebs, Pierson, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/812,783

(22) Filed: Mar. 9, 2020

(65) Prior Publication Data

US 2020/0205635 A1 Jul. 2, 2020

Related U.S. Application Data

(63) Continuation of application No. 15/895,417, filed on Feb. 13, 2018, now Pat. No. 10,602,902.

(60) Provisional application No. 62/462,055, filed on Feb. 22, 2017.

(51) Int. Cl.

| | |
|---|---|
| ***A47L 11/40*** | (2006.01) |
| ***A47L 13/256*** | (2006.01) |
| ***A47L 11/282*** | (2006.01) |
| ***A47L 11/283*** | (2006.01) |
| ***A47L 11/16*** | (2006.01) |
| ***A47L 13/22*** | (2006.01) |

(52) U.S. Cl.

CPC ..... *A47L 11/4083* (2013.01); *A47L 11/161* (2013.01); *A47L 11/282* (2013.01); *A47L 11/283* (2013.01); *A47L 11/4036* (2013.01); *A47L 11/4038* (2013.01); *A47L 13/22* (2013.01); *A47L 13/256* (2013.01)

(58) Field of Classification Search

CPC ..... A47L 11/40; A47L 13/256; A47L 11/282

See application file for complete search history.

(56) References Cited

U.S. PATENT DOCUMENTS

| | | | | |
|---|---|---|---|---|
| 3,013,288 | A | 12/1961 | Lappin | |
| 3,258,803 | A | 7/1966 | Wolter | |
| 3,425,081 | A | 2/1969 | Dix | |
| 4,733,432 | A | 3/1988 | Novoselsky | |
| 6,421,869 | B1 * | 7/2002 | Olsson | A47L 11/03 15/50.1 |

(Continued)

FOREIGN PATENT DOCUMENTS

| | | |
|---|---|---|
| CN | 204071989 U1 | 1/2015 |
| CN | 204336825 U1 | 5/2015 |

(Continued)

OTHER PUBLICATIONS

Patents Act 1977: Search Report Under Section 17(5), 4 pages, Jul. 26, 2018, South Wales.

*Primary Examiner* — Michael D Jennings

(74) *Attorney, Agent, or Firm* — McGarry Bair PC

(57) ABSTRACT

A floor cleaning apparatus in the form of a motorized floor mop that can deliver liquid to a surface to be cleaned is provided with a handle, a base, a fluid delivery system, a motorized agitation system and a multi-axis swivel joint coupling the handle with the base for movement of the handle. A lock-out mechanism selectively locks out one of the axes of rotation of the multi-axis swivel joint.

20 Claims, 10 Drawing Sheets

(56) References Cited

U.S. PATENT DOCUMENTS

| | | | | |
|---|---|---|---|---|
| 6,823,558 | B2 | 11/2004 | Lee | |
| 8,230,549 | B2 | 7/2012 | Tran | |
| 9,398,836 | B2 * | 7/2016 | Luedke | A47L 13/225 |
| 10,602,902 | B2 * | 3/2020 | Ding | A47L 11/282 |
| 2004/0163199 | A1 | 8/2004 | Hsu | |
| 2006/0048318 | A1 | 3/2006 | Goh | |
| 2008/0141472 | A1 * | 6/2008 | Jeutter | B25G 3/38 15/41.1 |
| 2014/0245555 | A1 * | 9/2014 | Thorne | A47L 9/28 15/228 |

FOREIGN PATENT DOCUMENTS

| | | | |
|---|---|---|---|
| CN | 204410745 | U1 | 6/2015 |
| CN | 105769073 | A | 7/2016 |
| EP | 2213424 | A2 | 8/2010 |
| KR | 101595727 | B1 | 2/2016 |
| KR | 101609444 | B1 | 4/2016 |
| WO | 2016159445 | A1 | 10/2016 |

* cited by examiner

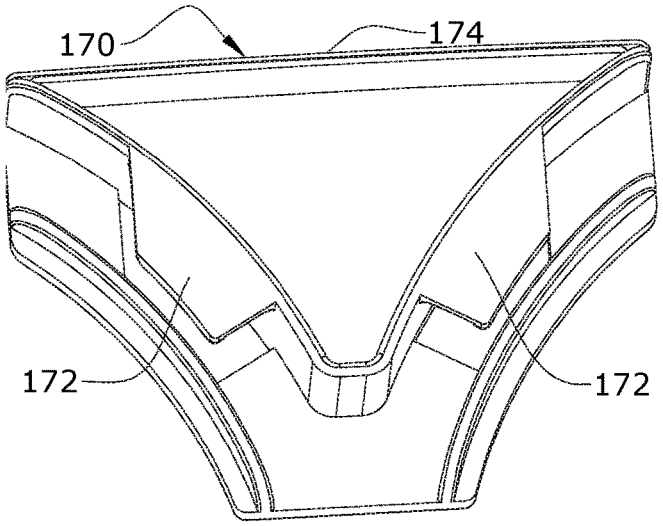
FIG.11
FIG.12A
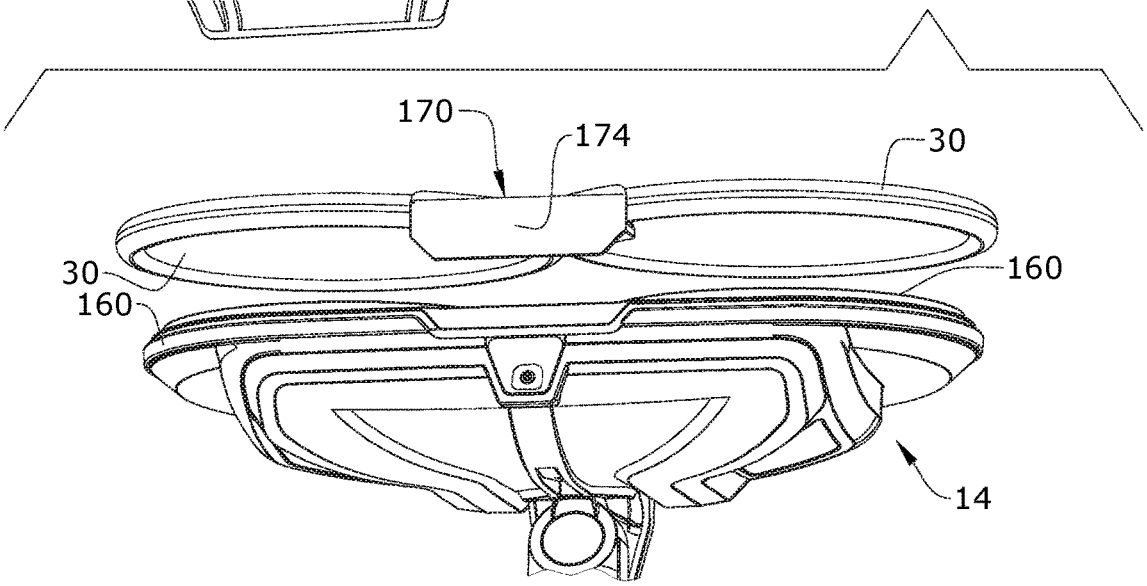
FIG.12B
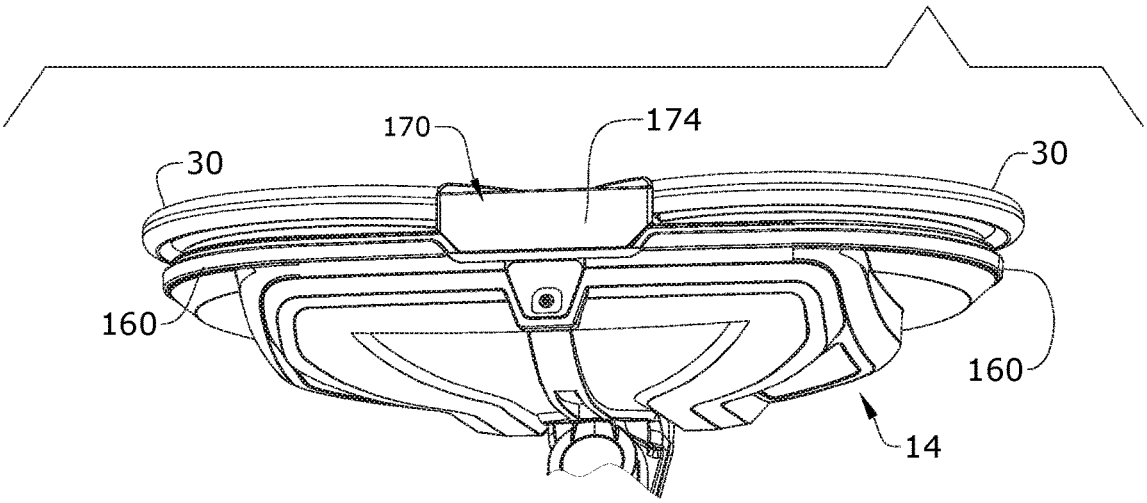

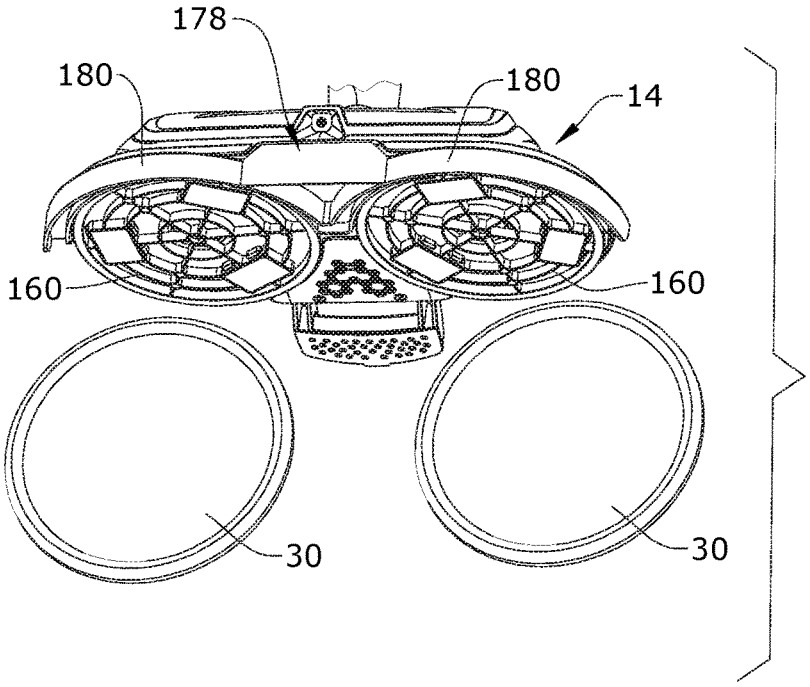
FIG.15A
FIG.15B
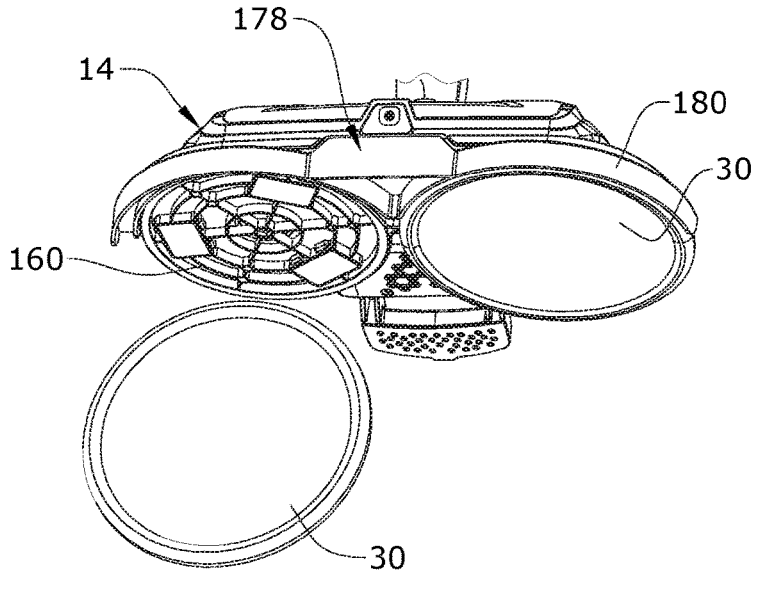

MOTORIZED FLOOR MOP

CROSS REFERENCE TO RELATED APPLICATION(S)

This application is a continuation of U.S. patent application Ser. No. 15/895,417, filed on Feb. 13, 2018, now U.S. Pat. No. 10,602,902, which claims the benefit of U.S. Provisional Patent Application No. 62/462,055, filed Feb. 22, 2017, all of which are incorporated herein by reference in their entirety.

BACKGROUND

Mops are well known devices for cleaning bare floor surfaces, such as tile, linoleum, vinyl, laminate, and hardwood floors. Some mops carry a reservoir for storing water or other cleaning solution that is fluidly connected to a selectively engageable pump or valve. The pump or valve outlet is fluidly connected to a nozzle or manifold mounted in the cleaning head. Liquid is typically applied to the backside of a mop pad or cloth attached to the foot. The damp pad is wiped across the surface to be cleaned to remove dirt, dust, and debris present on the cleaning surface. Some mops are motorized, and include a motor drive assembly for movement or rotation of the mop pad for enhanced agitation or scrubbing of the surface to be cleaned.

BRIEF DESCRIPTION

According to one aspect of the present disclosure, a floor cleaning apparatus, comprising a housing and a motorized agitation system operably coupled to the housing, the motorized agitation system comprising a plurality of rotatable pad holders provided on the housing, at least one drive motor operably coupled with the plurality of cleaning pads for rotation of the cleaning pads, a plurality of cleaning pads, and at least one removable pad alignment jig for simultaneously mounting the plurality of cleaning pads on the plurality of rotatable pad holders wherein the at least one drive motor is operably coupled with the plurality of rotatable pad holders and one of the plurality of cleaning pads is provided on each of the rotatable pad holders for rotation therewith.

BRIEF DESCRIPTION OF THE DRAWINGS

The present disclosure will now be described with respect to the drawings in which:

FIG. 11 is a perspective view of a pad alignment jig according to a first example;

FIGS. 12A-12B illustrate the use of the pad alignment jig of FIG. 11 in attaching cleaning pads to the floor mop;

FIGS. 15A-15B illustrates the use of the pad alignment jig of FIG. 13 in attaching cleaning pads to the floor mop;

DETAILED DESCRIPTION

The present disclosure relates to a surface cleaning apparatus such as a floor mop, for cleaning surfaces with liquid. More specifically, the present disclosure relates to a motorized floor mop that can deliver liquid to a surface to be cleaned and has at least one cleaning pad coupled with a drive motor for movement of the cleaning pad to agitate, scrub, and buff the surface to be cleaned.

Figure 1:
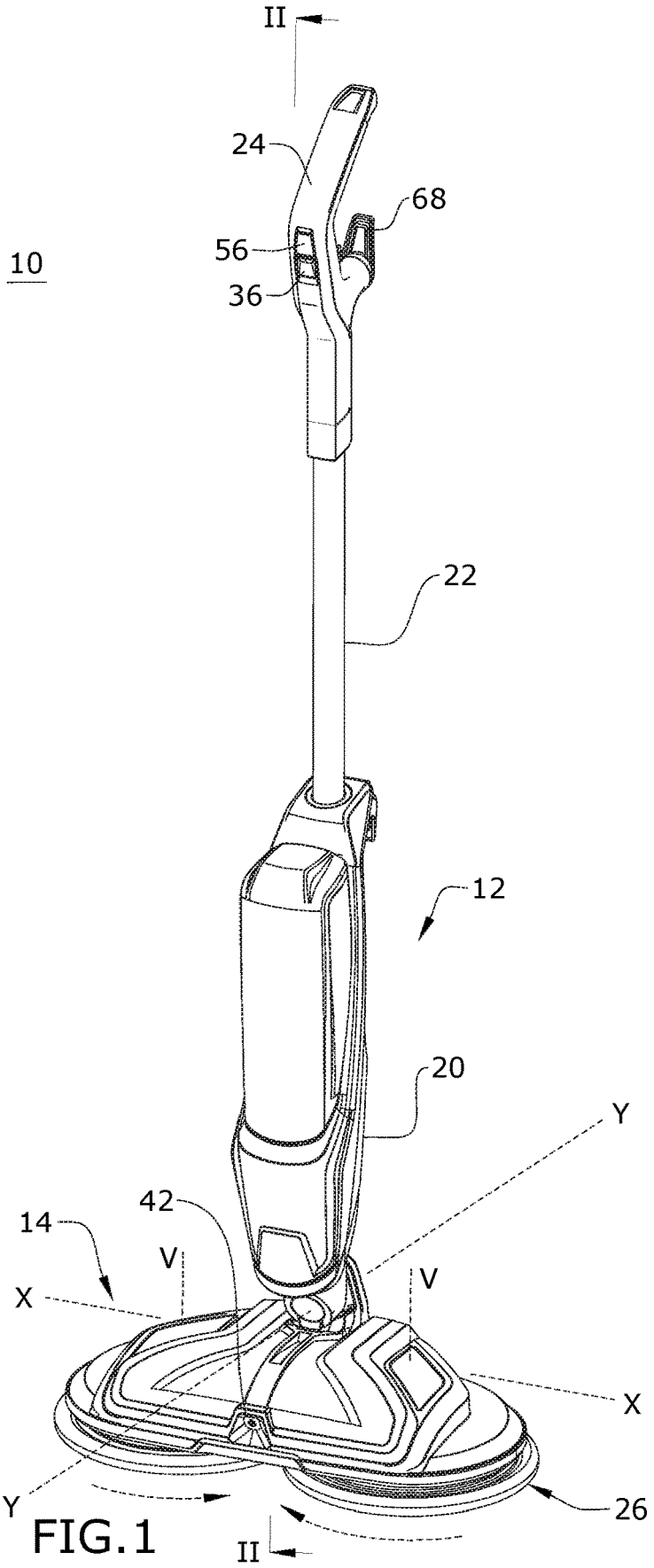
FIG. 1 is a front perspective view of a surface cleaning apparatus in the form of a motorized floor mop.

FIG. 1 is a front perspective view of a surface cleaning apparatus in the form of a motorized floor mop 10 according to one example of the present disclosure. The functional systems of the mop 10 can be arranged into any desired configuration, such as an upright device having a base and an upright body for directing the base across the surface to be cleaned or a canister device having a cleaning implement connected to a wheeled base by a hose.

As illustrated herein, the mop 10 is an upright mop 10 having a housing that includes an upright assembly 12 that is pivotally connected to a base 14 or cleaning head for directing the base 14 across the surface to be cleaned. The mop 10 can include a fluid delivery system for storing cleaning fluid and delivering the cleaning fluid to the surface to be cleaned and a motorized agitation system for agitating and scrubbing the fluid on the surface to be cleaned, including floor surfaces such as tile, linoleum, vinyl, laminate, and hardwood floors.

The various components of the fluid delivery system and motorized agitation system can be supported by either or both the base 14 and the upright assembly 12. Other examples of the mop 10 can include a vacuum or recovery system for removing debris and/or cleaning from the surface to be cleaned, which may include a suction nozzle, a suction source in fluid communication with the suction nozzle for generating a working air stream, and a collector for separating and collecting fluid and debris from the working airstream for later disposal. Other examples of the mop 10 can include a steam system for generating and delivering steam to the surface to be cleaned.

For purposes of description related to the figures, the terms "upper," "lower," "right," "left," "rear," "front," "vertical," "horizontal," "inner," "outer," and derivatives thereof shall relate to the present disclosure as oriented in FIG. 1 from the perspective of a user behind the mop 10, which defines the rear of the mop 10. However, it is to be understood that the present disclosure may assume various alternative orientations, except where expressly specified to the contrary.

The upright assembly 12 includes a main support section or frame 20 supporting components of the fluid delivery system. The upright assembly 12 also has an elongated handle 22 extending upwardly from the frame 20 that is provided with a hand grip 24 at one end that can be used for maneuvering the mop 10 over a surface to be cleaned. In other examples of the present disclosure not shown herein, the upright assembly 12 can essentially comprise the handle 22 and hand grip 24, with the various components of the fluid delivery system and motorized agitation system can be supported by the base 14.

Figure 2:
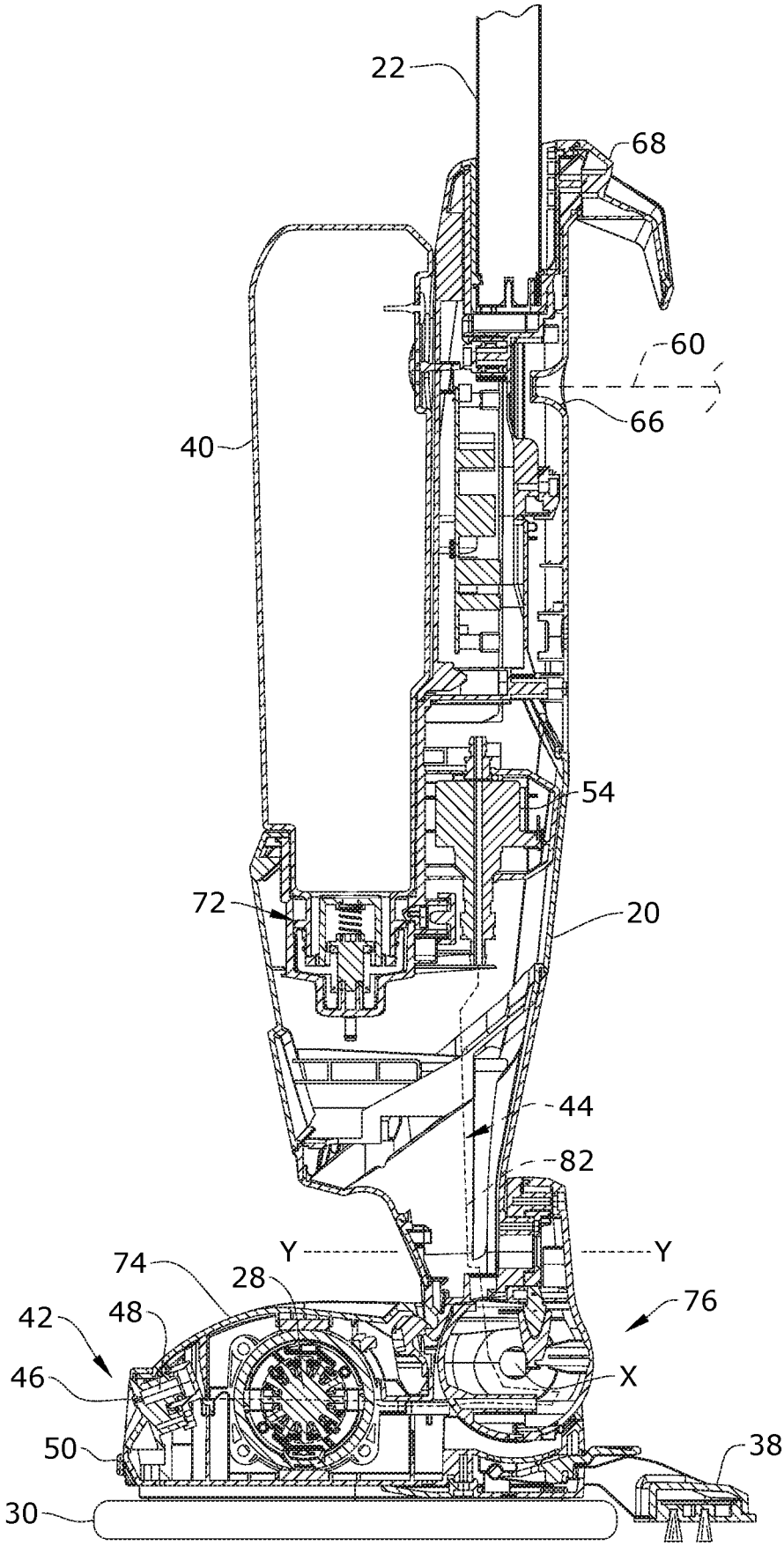
FIG. 2 is a sectional view of the floor mop taken through line II-II of FIG. 1.

With additional reference to FIG. 2, the motorized agitation system includes at least one agitator 26 adapted to be moved over the surface to be cleaned, and at least one drive motor 28 operably coupled with the at least one agitator 26 for supplying a driving movement the at least one agitator 26. In the example illustrated herein, the agitator system includes two rotating agitators 26 comprising cleaning pads 30. The cleaning pads 30 are rotatable about substantially vertical axes V that are laterally spaced from each other. In being substantially vertical, the axes V about which the cleaning pads 30 rotate can deviate up to 10° from vertical; the axes V are preferably configured such that the cleaning pads 30, as mounted on the base 14 are orthogonal to the surface to be cleaned to maximize the contact area between the cleaning pads 30 and the surface to be cleaned. The cleaning pads 30 scrub or agitate the surface to be cleaned so that debris is removed more easily. In one example, the agitators 26 are counter-rotating and can rotate the cleaning pads 30 in opposing directions as indicated by arrows in FIG. 1.

An actuator 36 can be provided to selectively actuate the motorized agitation system and rotate the cleaning pads 30. The actuator 36 can be operably coupled to the drive motor 28 such that pressing the actuator 36 will activate the drive motor 28. The mop 10 can further optionally include one or more non-motorized agitators. As shown, an optional auxiliary scrubber 38 is also provided and can be non-motorized.

The fluid delivery system can include at least one fluid container or supply tank 40 for storing a supply of fluid, at least one fluid distributor 42 for delivering fluid to the surface to be cleaned, and a fluid delivery pathway 44 via which fluid is delivered from the supply tank 40 to the at least one fluid distributor 42. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent. The supply tank 40 can be removable from the mop 10 for refilling the tank with liquid, or can be refilled when on the mop 10.

The fluid distributor 42 can include at least one distributor outlet 46 for delivering fluid to the surface to be cleaned. The at least one distributor outlet 46 can be positioned to deliver fluid directly to the surface to be cleaned, or indirectly by delivering fluid onto the cleaning pads 30. The at least one distributor outlet 46 can comprise any structure, such as a nozzle or spray tip; multiple outlets 46 and/or fluid distributors 42 can also be provided. As illustrated, the fluid distributor 42 can comprise a spray tip 48 provided on a front side 50 of the base 14 to distribute cleaning fluid directly to the surface to be cleaned. In this location, the outlet 46 of the spray tip 48 is configured to spray fluid outwardly in front of the base 14, preferably forward of the cleaning pads 30, rather than under the base 14 or directly onto the cleaning pads 30, so that a user of the mop 10 can see where fluid is being applied.

The fluid delivery system can further comprise a flow control system for controlling the flow of fluid from the at least one supply tank 40 to at least one fluid distributor 42. In one configuration, the flow control system can comprise a pump 54 in the fluid delivery pathway 44 which pressurizes the fluid delivery system and delivers fluid from the tank 40 to the distributor 42. An actuator 56 can be provided to actuate the flow control system and dispense fluid to the distributor 42. The actuator 56 of the present example can be operably coupled to the pump 54 such that pressing the actuator 56 will activate the pump 54.

An electronic control circuit can be provided for controlling the electronic components of the mop 10. In the illustrated example the drive motor 28 and the pump 54 can be electronically coupled to a power source 60, such as a battery or by a power cord plugged into a household electrical outlet, by the control circuit. An electrical switch can be provided between the pump 54 and the power source that is selectively closed when the delivery actuator 56 is pressed, thereby powering the pump 54 to pressurize the pathway 44 and deliver fluid from the tank 40 to the distributor 42. In one example, the pump 54 can be a solenoid pump. An electrical switch can also be provided between the drive motor 28 and the power source that is selectively closed when the drive actuator 36 is pressed, thereby powering the drive motor 28 to rotate the cleaning pads 30. In the illustrated example, the drive and delivery actuators 36, 56 can be provided as buttons on the front side of the hand grip 24, although other forms and locations are possible.

As shown herein, a power source 60 in the form of a power cord can emerge from the interior of the upright assembly 12 through a cord aperture 66, can be used to provide power to electrical components of the mop 10 from a home power supply, upon actuation of the actuators 36, 56. The power cord can be stored on cord wraps 68 on the handle 22. Alternatively, the mop 10 can be powered by a portable power source, such as a battery.

Optionally, a heater can be provided for heating the cleaning fluid prior to delivering the cleaning fluid to the surface to be cleaned. In yet another example, the cleaning fluid can be heated using exhaust air from a motor-cooling pathway for the drive motor 28. In yet another configuration of the fluid delivery system, the pump 54 can be eliminated and the flow control system can comprise a gravity-feed system having a valve fluidly coupled with an outlet of the tank 40, whereby when valve is open, fluid will flow under the force of gravity to the distributor 42. The valve can be mechanically actuated or electrically actuated, as described above.

In the illustrated example, the main support section or frame 20 of the upright assembly 12 supports at least the tank 40 and the pump 54. The frame 20 of the upright assembly 12 can include a receiver 72 for removably receiving the tank 40 for support on the upright assembly 12.

The base 14 includes a base housing 74 supporting components of the fluid delivery system and the agitation system, including, but not limited to, the distributor 42, cleaning pads 30, and drive motor 28 in the illustrated example. A multi-axis swivel joint 76 couples the base housing 74 to the upright assembly 12 for movement about at least two orthogonal axes of rotation X, Y. In one example, the swivel joint 76 can be a universal joint. In the example illustrated herein, the fluid delivery pathway 44 includes at least one conduit 82 extending through the swivel joint 76. The conduit 82 can comprise a flexible hose or tubing which will flex as the swivel joint 76 is articulated about its axes of rotation.

The mop 10 shown in FIGS. 1-2 can be used to effectively clean floors in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the mop 10 is prepared for use by coupling the mop 10 to the power source, and by filling the tank 40 with cleaning fluid. Cleaning fluid is selectively delivered to the surface to be cleaned via the fluid delivery system by user-activation of the delivery actuator 56. The drive motor 28 is selectively activated to rotate the cleaning pads 30 by user-activation of the drive actuator 36. The mop 10 is moved back and forth over the surface to clean the surface. It is noted that the fluid delivery and agitation systems can be simultaneously actuated, or actuated one at a time, i.e. individually, as desired by the user, as separate controls are provided via the separate actuators 36, 56. The cleaning pads 30 can be removed from the mop 10 as needed for cleaning or replacement.

Figure 3:
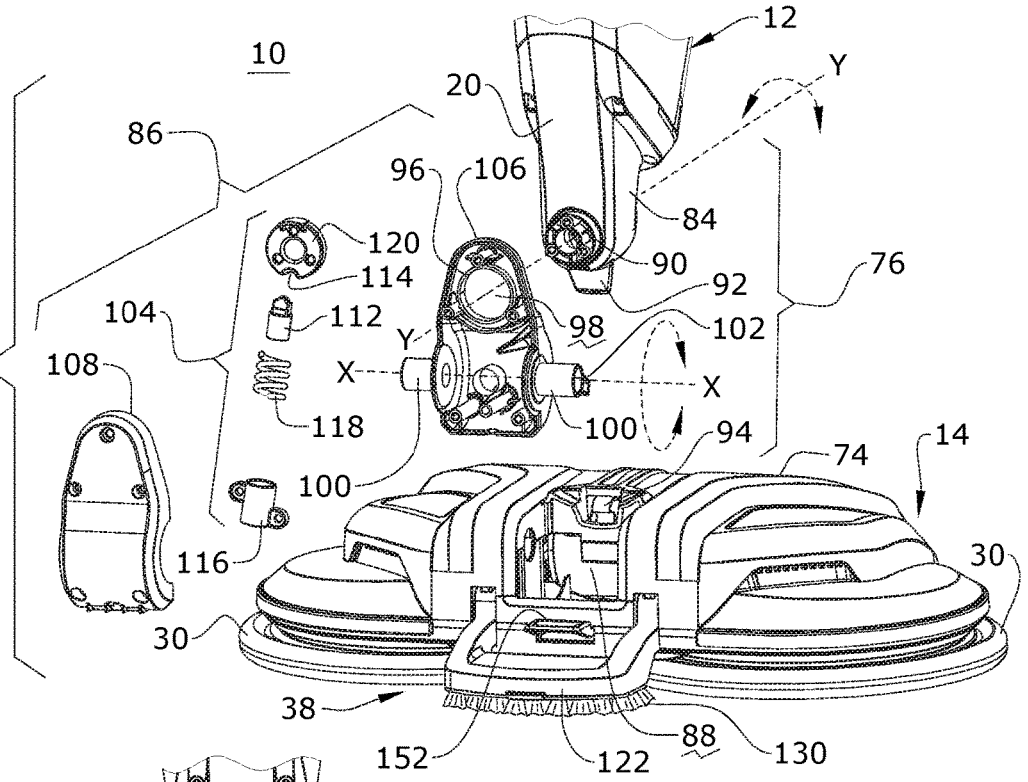
FIG. 3 is rear, partially exploded view of a lower portion of the floor mop of FIG. 1.

FIG. 3 is a rear view of a lower portion of the mop 10. The swivel joint 76 includes an upper upright connector 84 and a lower base connector 86, and can accommodate the conduit 82 (FIG. 2) forming at least part of the fluid delivery pathway 44 which extends through the swivel joint 76. The base 14 comprises a cradle 88 in the base housing 74 for accommodating the swivel joint 76. The upright connector 84 pivotally couples with the base connector 86 and defines the second axis of rotation Y about which the upright assembly 12 can rotate in a general side-to-side direction. The base connector 86 in turn pivotally couples with the base 14 and defines the first axis of rotation X about which the upright assembly 12 can rotate in a general front-to-back direction.

The upright connector 84 is coupled with a lower portion of the upright assembly 12, such as with a lower portion of the frame 20, and a pivot portion 90 extends rearwardly from the connector 84.

The swivel joint 76 further includes a lock-out mechanism that is configured to selectively lock out the front-to-back pivot of the swivel joint 76 about the first axis X. The upright connector 84 has a locking projection 92 which selectively mates with a receiving seat 94 in the base 14 when the upright assembly 12 is brought into an upright storage position (shown in FIGS. 1, 2 and 4, for example) to lock out the front-to-back pivot of the swivel joint 76 about the first axis X. Locking out the front-to-back pivot allows the mop 10 to be self-supporting in the upright storage position, i.e. the mop 10 can stay upright without being supported by something else. Other configurations for the front-to-back lock-out mechanism are also possible.

The base connector 86 includes a receiver 96 having a bore 98 formed therethrough which pivotally receives the pivot portion 90 on the upright connector 84 for rotation about the second axis Y. The base connector 86 further has opposing pivot arms 100 which are rotatably received in the cradle 88 formed in the base 14 for rotation about the first axis X. The pivot portion 90 extends orthogonally to the opposing pivot arms 100.

At least one of the pivot arms 100 can be hollow for routing the conduit 82 (FIG. 2) through the swivel joint 76 and into the base 14. One or both of the pivot arms 100 can further include a stop arm 102 protruding radially therefrom, i.e. radially with respect to the first axis X. The stop arm 102 engages a stop (not shown) in the base 14 which limits the forward movement of upright assembly 12 relative to the base 14.

Figure 4:
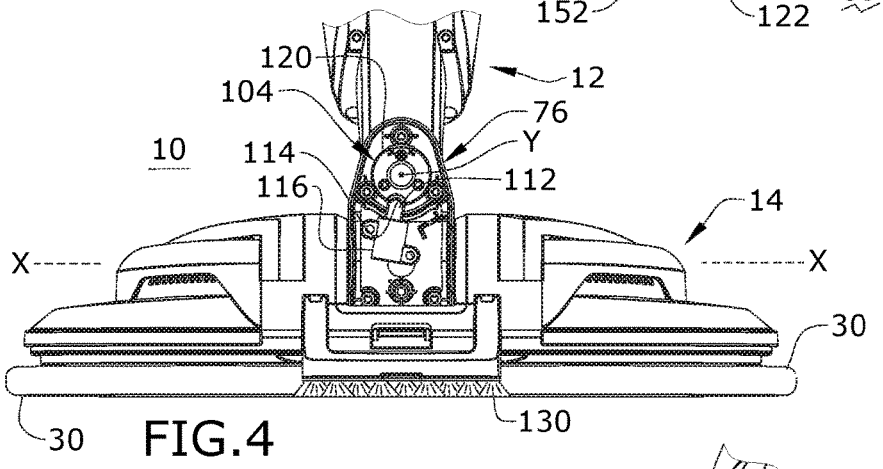
FIG. 4 is rear view of a lower portion of the floor mop of FIG. 1, with a rear cover of the swivel joint removed to show a detent of the swivel joint in a locked position.
Figure 5:
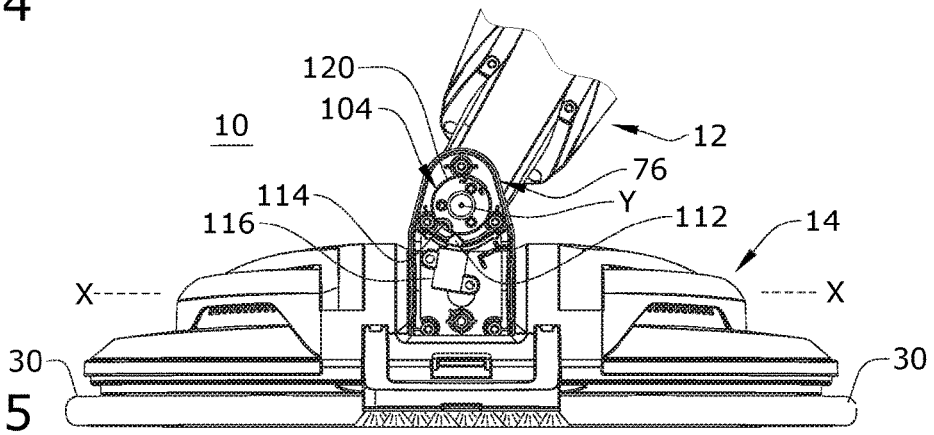
FIG. 5 is view similar to FIG. 4 showing the detent of the swivel joint in an unlocked position.

Referring additionally to FIGS. 4-5, the swivel joint 76 further includes a lock-out mechanism 104 that is configured to selectively lock out the side-to-side pivot of the swivel joint 76 about the second axis Y. Locking out the side-to-side pivot makes it easier for a user to maneuver and control the base 14 while the counter-rotating cleaning pads 30 are spinning, as the counter-rotation of the cleaning pads 30 causes the mop 10 to "glide" over the surface during operation. The mop 10 may also be used with the drive motor 28 inactive and the cleaning pads 30 not rotating, in which case the side-to-side pivoting action may be desired.

The base connector 86 as illustrated has front and rear housings 106, 108 which mate together around the lock-out mechanism 104 to enclose the lock-out mechanism within the housings 106, 108. The receiver 96 and pivot arms 100 are formed on the front housing 106 in the illustrated example, although one or both may also be provided on the rear housing 108. Other configurations for the upright connector 84 and base connector 86 are also possible.

The lock-out mechanism 104 of the illustrated example is provided in the form of a detent that is configured to temporarily keep the upright assembly 12 in a centered or neutral position relative to the base 14, while still allowing the upright assembly 12 to pivot about the first axis X. The detent can be configured to be released by applying a predetermined amount of force to one of the upright assembly 12 and the base 14. In the illustrated example, the detent includes a spring-biased plunger 112 operatively coupled with the base 14 and a detent notch 114 operatively coupled with the upright assembly 12 and configured to receive the plunger 112. Alternatively, the plunger 112 can be provided on the upright assembly 12 and the notch 114 can be provided on the base 14.

As shown, the plunger 112 is received within and axially moveable relative to a plunger housing 116 fixed within the base connector 86. The plunger 112 is biased relative to the plunger housing 116 by a coil spring 118. The detent notch 114 is provided on a disk 120 fixed with the upright connector 84, such that the detent notch 114 rotates relative to the base 14 and plunger 112 as the upright assembly 12 pivots side-to-side about the second axis Y.

FIGS. 4-5 are rear views of a lower portion of the mop 10, with the rear housing 108 of the swivel joint 76 removed to show the lock-out mechanism 104 or detent of the swivel joint 76 in locked and unlocked positions, respectively. The detent plunger 112 engages the notch 114 when the upright assembly 12 is orthogonal to the base 14, i.e. in a neutral position of zero rotation about second axis Y as shown in FIG. 4. A user can apply force to the upright assembly 12 to overcome the detent by forcing the plunger 112 to retract into the plunger housing 116 against the biasing force of the spring 118, thereby clearing the notch 114 as shown in FIG. 5, so the upright assembly 12 can rotate about the second axis Y and pivot side-to-side relative to the neutral position. This allows the base 14 to be oriented so a shorter side defines the leading edge, which may be helpful for cleaning narrow spaces or along baseboards, etc., as explained in further detail with respect to FIGS. 6-7.

Figure 6:
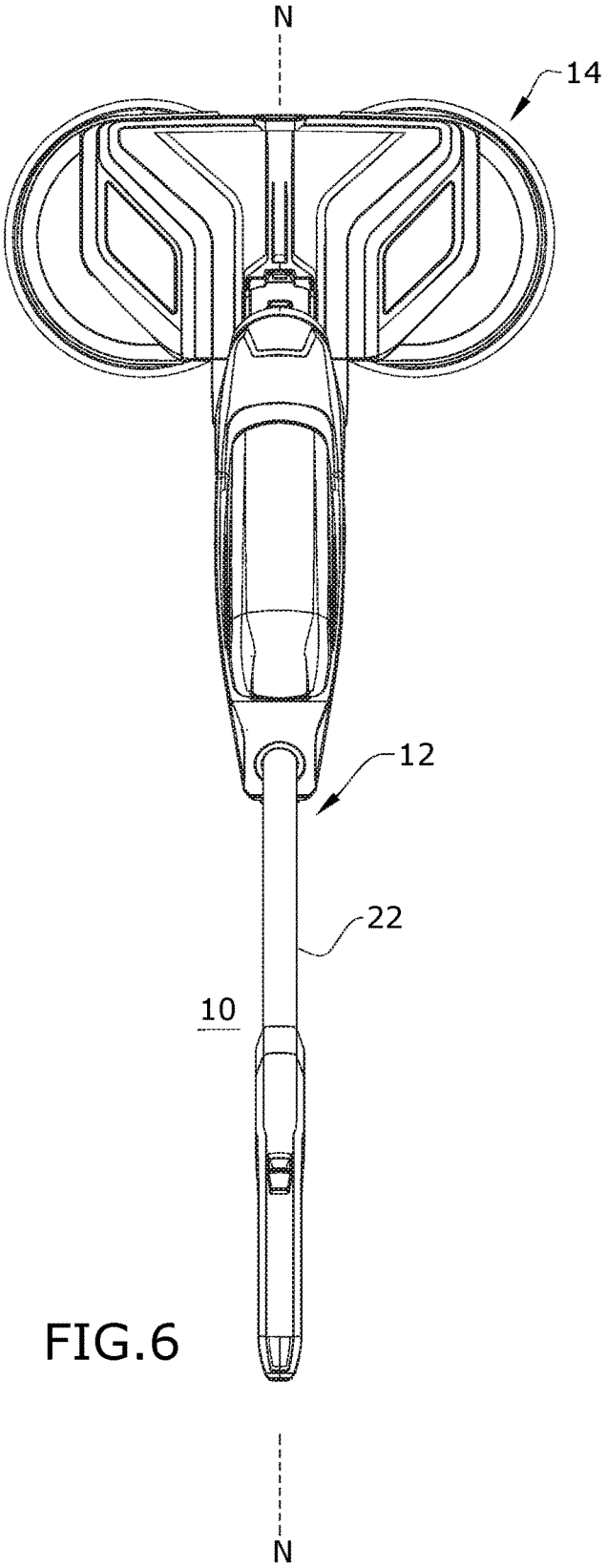
FIG. 6 is a top view of the floor mop of FIG. 1 in a reclined use position with the upright assembly in a neutral position relative to the base.
Figure 7:
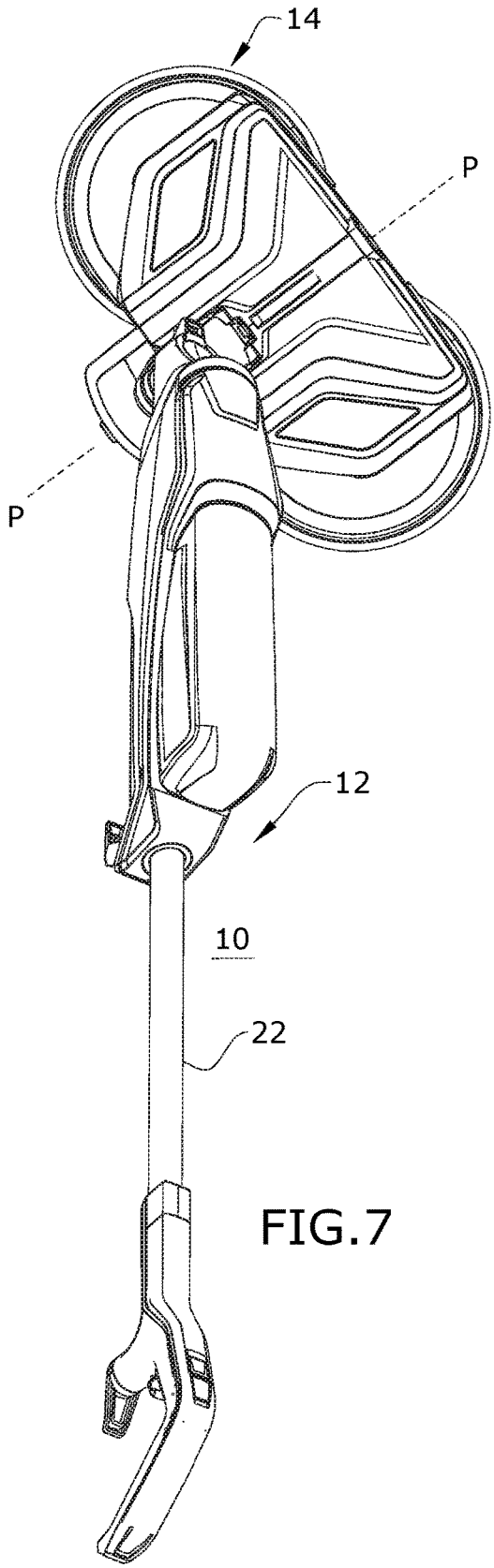
FIG. 7 is a top view of the floor mop of FIG. 1 in a reclined use position with the upright assembly in a pivoted position relative to the base.

FIGS. 6-7 are top views of the mop 10 in a reclined use position in which the upright assembly 12 is in the neutral position N and a pivoted position P, respectively. In the neutral position N, the lock-out mechanism 104 or detent is locked and the base 14 is oriented so a longer side defines the leading edge, which may be helpful for cleaning larger areas and spaces. The leading edge of the base 14 is the edge or side of the base 14 oriented orthogonal to the direction of travel of the mop 10 during operation. The direction of travel refers to a direction of movement along an imaginary vertical plane passing through the handle 22. In the pivoted position P of FIG. 7, the lock-out mechanism 104 or detent is unlocked and the base 14 is oriented so a shorter side defines the leading edge, which may be helpful for cleaning narrow spaces or along baseboards, etc. It is noted that FIG. 7 shows one exemplary pivoted position, and that the mop 10 can be moved to other pivoted positions not shown, such as with the long side of the base 14 oriented parallel to the handle 22, for example.

Figure 8:
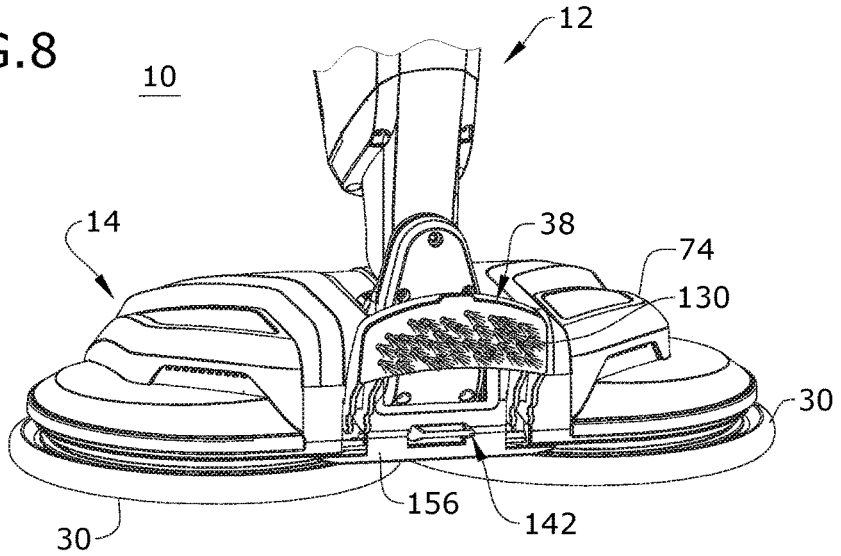
FIG. 8 is a rear perspective view of the base, illustrating an auxiliary scrubber in a non-use position.

FIG. 8 is a rear perspective view of the base 14 showing the optional auxiliary scrubber 38. The auxiliary scrubber 38 can be a flip-down agitator provided at a rear side of the base 14 for selectively scrubbing the surface to be cleaned, in combination with the counter-rotating cleaning pads 30. As illustrated herein, the scrubber 38 is pivotally coupled to a rear portion of the base housing 74 and is configured for movement between a first position shown in FIG. 2 and a second position shown in FIG. 8. In the first position, the scrubber 38 is in a use position and contacts the surface to be cleaned to provide enhanced, localized agitation of the surface to be cleaned. In this position, the user can optionally tilt the mop 10 rearwardly to provide even more pressure on the surface to be cleaned via the scrubber 38. In the second position, the scrubber 38 is in a non-use position and does not contact the surface to be cleaned.

Figure 9:
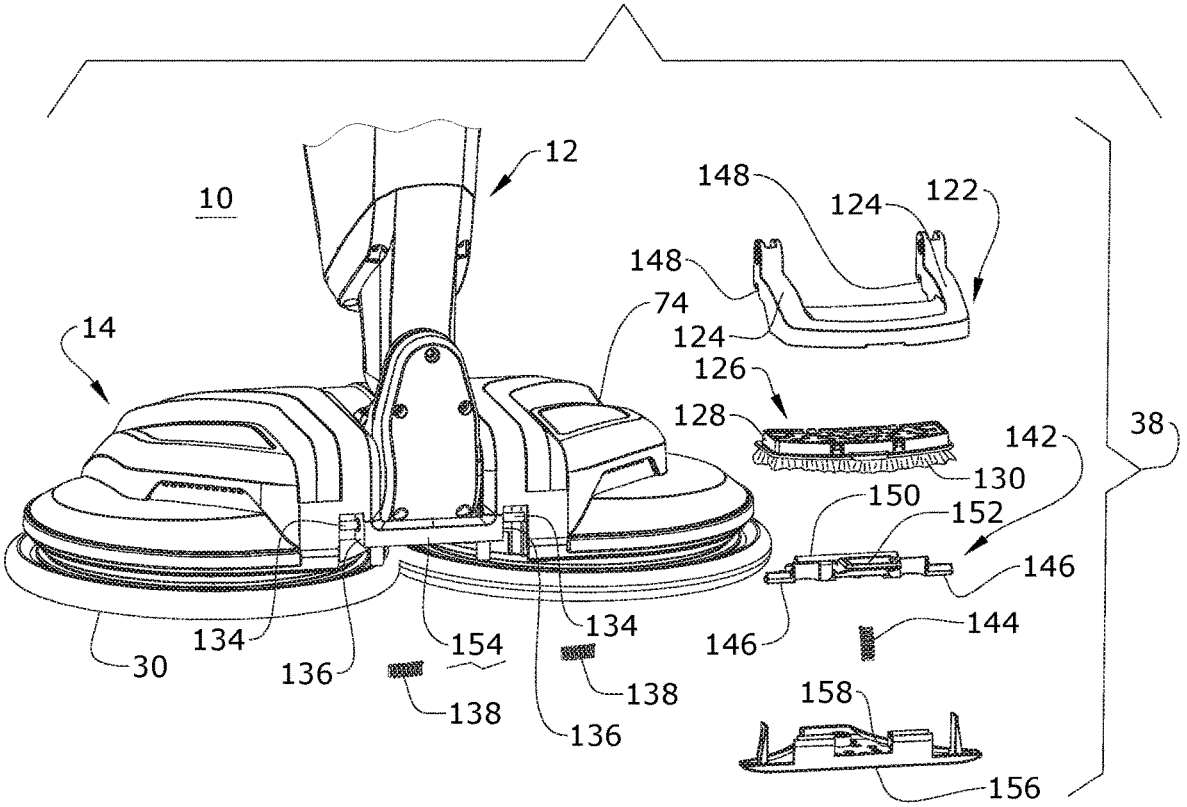
FIG. 9 is a rear perspective view of the base, with the auxiliary scrubber exploded for illustrative purposes.

FIG. 9 is a rear perspective view of the base 14, with the scrubber 38 exploded for illustrative purposes. The scrubber 38 comprises an agitator housing 122 with support arms 124 extending perpendicularly from the ends thereof. The top of the housing 122 is adapted to be pressed by a foot of the user to move the scrubber 38 to the use position. The bottom of the housing 122 is adapted to receive an agitator element 126 that is separate from the cleaning pads 30. The agitator element 126 can comprise a variety of materials that are configured to agitate or scrub the surface to be cleaned. The agitator element 126 can comprise materials that are dissimilar from the cleaning pads 30. In one example the agitator element 126 is a brush block 128 having a plurality of bristles 130. The bristles 130 can be made from plastic, and can be integrally molded with the brush block 128 or can comprise tufts of individual bristle filaments attached to the brush block 128. One example of a suitable material for a molded brush block 128 includes, but is not limited to, low-density polyethylene (LDPE). Examples of suitable materials for the tufted bristles 130 include, but are not limited to nylon 6-6, polyester or polyethylene terephthalate (PET), or polybutylene terephthalate (PBT). Other examples of the agitator element 126 are also possible, such as a foam block or nonwoven pad, for example.

The agitator element 126 is configured to be attached or otherwise supported by the housing 122 and partially spans the back portion of the base housing 74. The agitator element 126 can be configured to float relative to the agitator housing 122 to automatically adjust to different floor surface features. The scrubber 38 can include separable fasteners between the agitator element 126 and the agitator housing 122, such as snaps as shown or hook and loop fasteners, for example, that are configured to detachably secure the agitator element 126 to the agitator housing 122. Thus, the agitator element 126 can be removed from the housing 122 for cleaning, replacement or for exchanging the type of agitator element 126. Alternatively, the agitator element 126 can be permanently affixed to the housing 122.

A mounting assembly pivotally mounts the agitator housing 122 to the base 14. The mounting assembly can comprise a pair of spaced pivot pins 134 which couple each support arm 124 to corresponding bearing openings 136 in the base housing 74. A torsion spring 138 can be mounted around each pivot pin 134 to bias the agitator housing 122 upwardly relative to the base 14 toward the non-use position shown in FIG. 8.

The base 14 can further comprise a latching assembly for selecting locking the scrubber 38 in the use position. The latching assembly comprises a latch 142 and a compression spring 144 for biasing the latch 142 toward a latched position. The latch 142 has catches 146 at a lower portion thereof for engaging hooks 148 on the support arms 124, a pivot shaft 150 for pivotally attaching the latch 142 to the base 14, and an actuator in the form of a foot pedal 152 operably coupled with the catches 146. A latch opening 154 is provided in the base housing 74 for receiving the latch 142, and a bottom cover 156 mounts the latch 142 to the base housing 74, with the foot pedal 152 extending through an opening 158 in the bottom cover 156.

The spring 144 can be positioned between the latch 142 and the bottom cover 156, for example, and biases the latch 142 about the pivot shaft 150 toward a position where the catches 146 engage the hooks 148. When the scrubber 38 is down in the use position, the latch foot pedal 152 is above the agitator housing 122 (see FIG. 3) so that it can be pressed downwardly to pivot the latch 142 about the pivot shaft 150, which releases the catches 146 from the hooks 148. The torsion springs 138 bias the freed scrubber 38 upwardly about the pivot pins 134.

In the use position shown in FIG. 2, the agitator element 126 is positioned rearwardly of the base housing 74. A user can selectively pivot the scrubber 38 into the use position to clean heavily soiled areas on the surface to be cleaned by pressing the housing 122 with their foot. The hooks 148 on the housing 122 are rotated into engagement with the catches 146 of the latching assembly, and the scrubber 38 is locked in the use position. With the scrubber 38 in the use position, a user can make one or more reciprocal cleaning strokes to scrub the soiled area. To move the scrubber 38 from the use position to the non-use position shown in FIG. 8, the foot pedal 152 is pressed, which unlocks the scrubber 38 so that it is free to rotate upwardly to the non-use position, in which the agitator element 126 is spaced from the surface to be cleaned.

Figure 10:
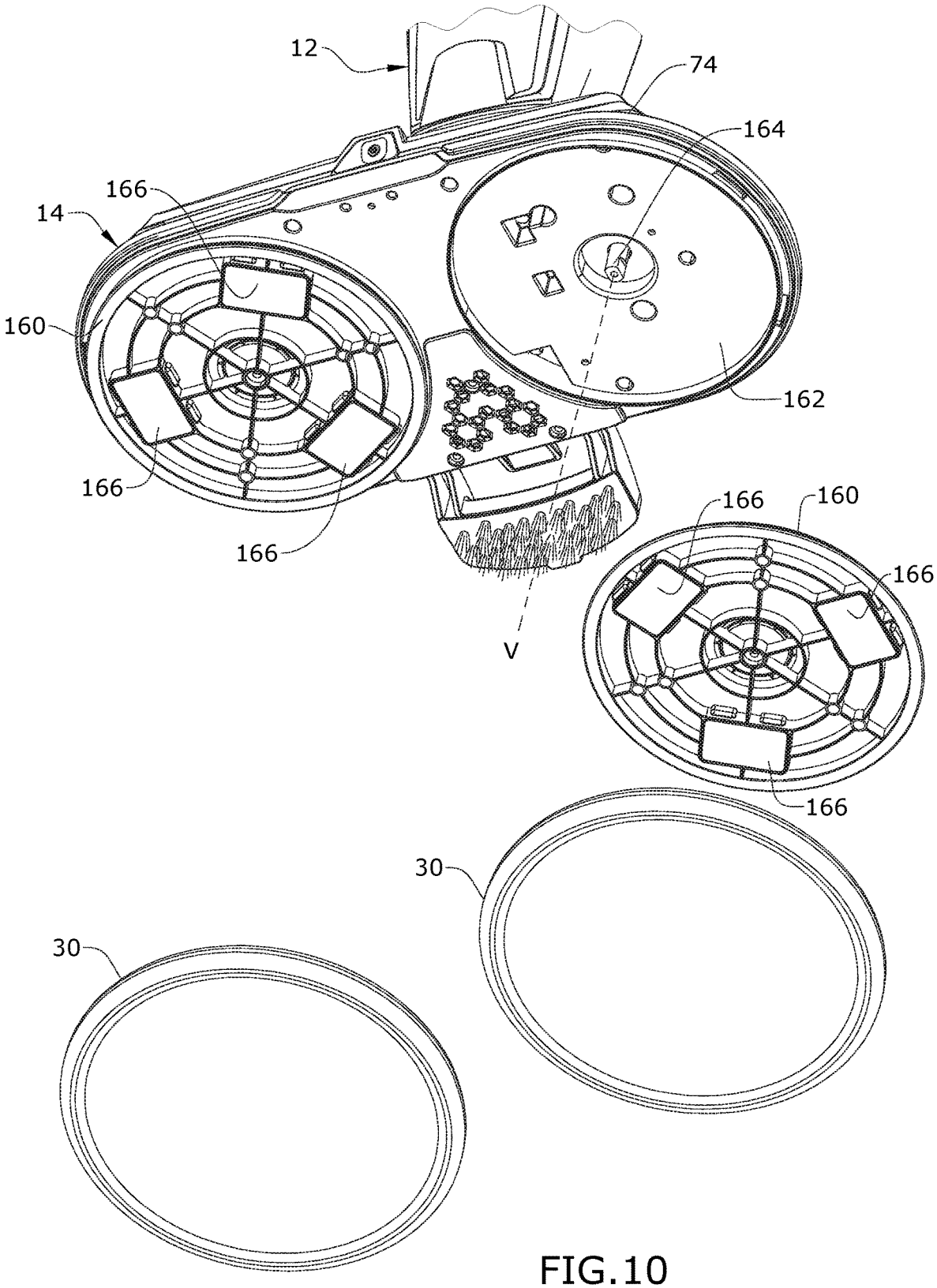
FIG. 10 is a partially exploded bottom perspective view of the base.

FIG. 10 is a partially exploded bottom perspective view of the base 14. The cleaning pads 30 are mounted on rotation plates or rotatable pad holders 160 on the bottom of the base 14. The base housing 74 includes a bottom cover 162 through which drive shafts 164, which are operably connected to the drive motor 28 (FIG. 2) extend to couple with the pad holders 160. The drive motor 28 rotates the two drive shafts 164 via a suitable transmission, such as a worm gear assembly (not shown) that rotates the pad holders 160 such that the cleaning pads 30 counter-rotate. The coupling between the drive shafts 164 and the rotatably-driven pad holders 160 define vertical axes of rotation V for the pads 30, relative to the surface to be cleaned. While a single drive motor 28 is shown herein, it is understood that the motorized agitation system can comprise multiple drive motors 28, each of which is operably coupled with at least one cleaning pad 30 via a suitable transmission for rotation of the at least one cleaning pad 30.

The pad holders 160 can include fasteners 166 for removable attachment of the cleaning pads 30, such as hook and loop fasteners as illustrated, or snaps or magnets for example. Thus, the cleaning pads 30 can be removed from the base 14 for cleaning or replacement. In one example, the cleaning pads 30 comprise soft microfiber material which can be removed for cleaning when the pads 30 become soiled. The soiled pads 30 can be laundered and re-used. The cleaning pads 30 may be used for more than one mopping session prior to being laundered. Alternatively, disposable cleaning pads 30 for one-time or limited use can be provided.

Both the cleaning pads 30 and the pad holders 160 can be circular in shape. Mounting circular cleaning pads 30 precisely on circular pad holders 160 presents a challenge because of their position on the underside of the base 14. Incorrect alignment between the pads 30 and pad holders 160 can cause an unbalanced feeling and/or vibration in the hand grip 24 during use. To resolve this issue, a pad alignment jig can be provided. The pad alignment jig is used when preparing the mop 10 for operation in order to simultaneously mount and align the cleaning pads 30 on the pad holders 160. The pad alignment jig is removed prior to use of the mop 10 to clean a floor surface.

FIG. 11 is a perspective view of a pad alignment jig 168 according to a first example. The pad alignment jig 168 is formed as a clip tool 170 which connects the two cleaning pads 30 together in proper spacing for the mop 10. The tool 170 has two arcuate retainers 172 for the cleaning pads 30 and a grip 174, and is generally V-shaped to fit between the pad holders 160 on the base 14.

As shown in FIGS. 12A-12B, the mop 10 can be turned on its side to expose the bottom of the base 14, and then the tool 170 with attached cleaning pads 30 can be brought into engagement with the pad holders 160 while holding the grip 174. The tool 170 holds the cleaning pads 30 in proper alignment with the pad holders 160, and the user can press the cleaning pads 30 against the hook and loop pad fasteners 166 to transfer the pads 30 to the mop 10, and pull the tool 170 away from the base 14 by the grip 174.

Figure 13:
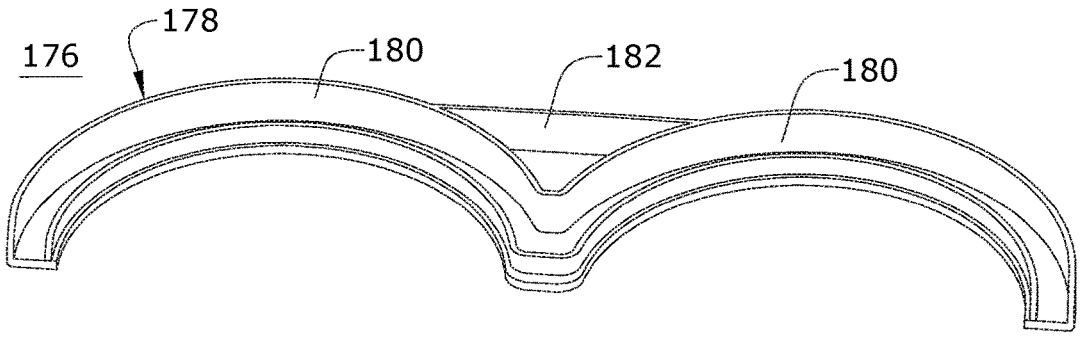
FIG. 13 is a top perspective view of a pad alignment jig according to a second example.
Figure 14:
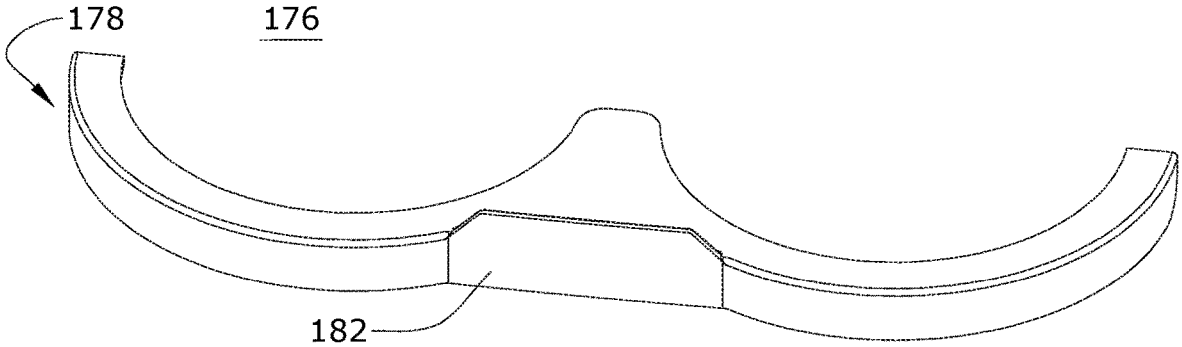
FIG. 14 is a bottom perspective view of the pad alignment jig of FIG. 13.

FIGS. 13-14 are top and bottom perspective views of a pad alignment jig 176 according to a second example. The pad alignment jig 176 is formed as a rule-type tool 178 which is first connected to the base 14 in order to define the area in which the cleaning pads 30 should be mounted for proper alignment. The tool 178 has two arcuate or semi-circular receivers 180 for the pad holders 160 and a grip 182 generally between the receivers 180, and is shaped to fit at least partially around the pad holders 160 on the base 14.

As shown in FIGS. 15A-15B, the mop 10 can be turned on its side to expose the bottom of the base 14, and then the tool 178 can be brought into engagement with the base 14 by fitting the receivers 180 around the pad holders 160. The inner contour of the receivers 180 defines a space in which the cleaning pads 30 are fitted for proper alignment with the pad holders 160. The user can abut the edge of the cleaning pads 30 against the inner contour and press the cleaning pads 30 against the hook and loop pad fasteners 166 to attach the pads 30 to the mop 10, and then pull the tool 178 away from the base 14.

Figure 16:
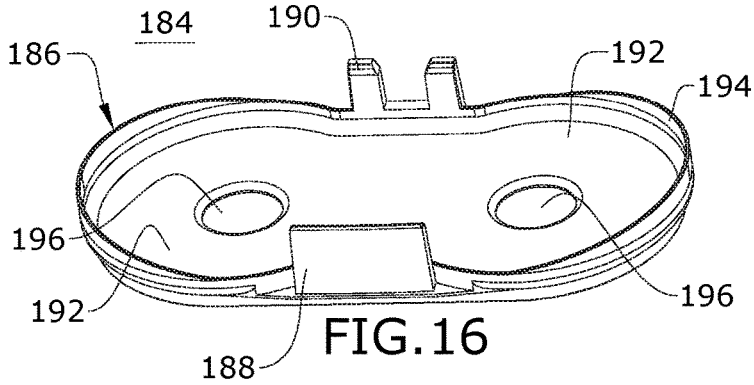
FIG. 16 is a top perspective view of a pad alignment jig according to a third example.
Figure 17:
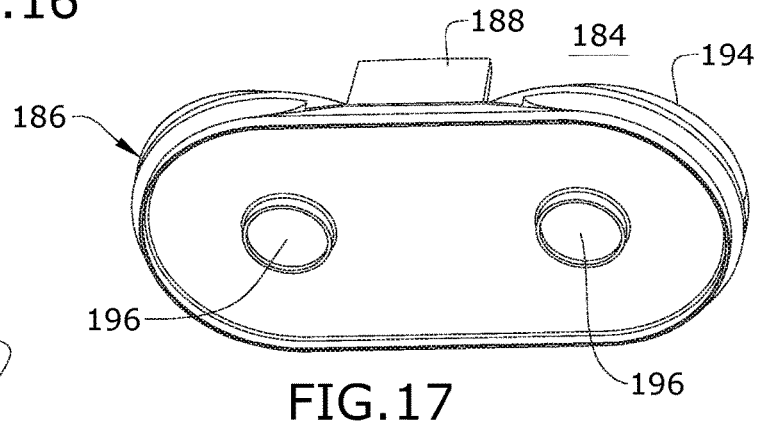
FIG. 17 is a bottom perspective view of the pad alignment jig of FIG. 16.

FIGS. 16-17 are top and bottom perspective views of a pad alignment jig 184 according to a third example. The pad alignment jig 184 is formed as a tray 186 which receives the two cleaning pads 30 in proper spacing for the mop 10. The tray 186 is oval in shape, with front and rear guides 188, 190 projecting upwardly from the flat sides of the oval and two circular contours 192 around the inner rim 194 for receiving the cleaning pads 30. Two circular depressions 196 are formed in the tray 186, in general alignment with the center of the cleaning pads 30 and pad holders 160.

Figure 18A:
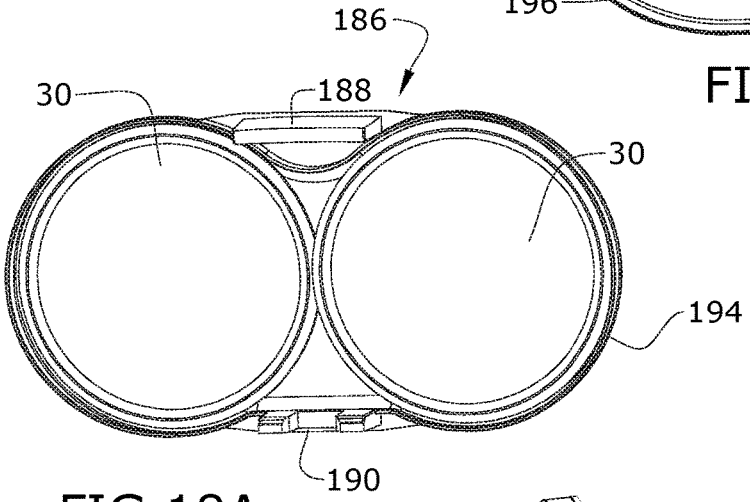
FIGS. 18A-18B illustrate the use of the pad alignment jig of FIG. 16 in attaching cleaning pads to the floor mop.
Figure 18B:
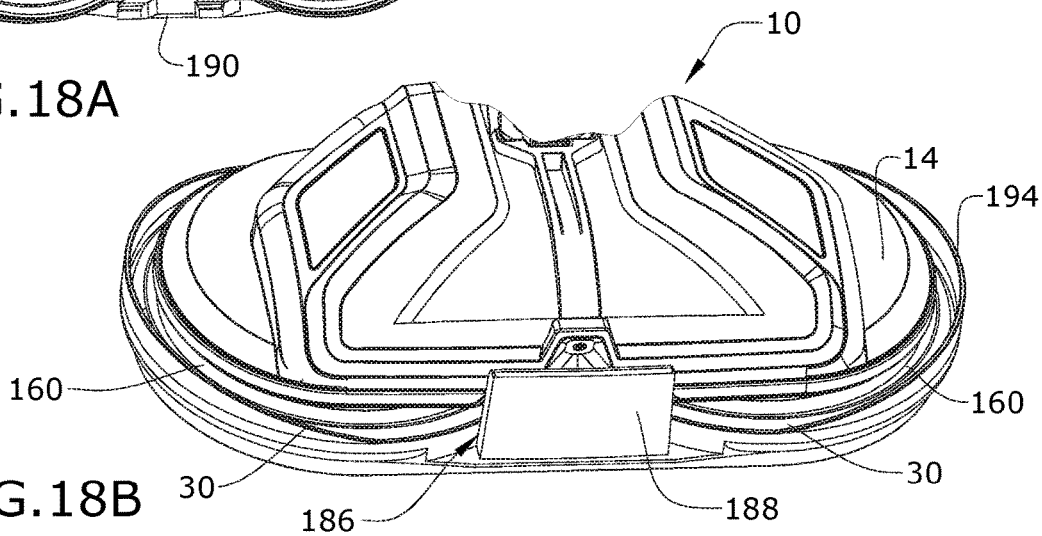

As shown in FIG. 18, the tray 186 can be placed on a floor surface with the cleaning pads 30 received within the circular contours 192 and bordered by the rim 194, and with the backside of the cleaning pads 30 facing upwardly. The mop 10 is lowered onto the tray 186, with the base 14 received with the perimeter of the tray 186 defined by the rim 194. The guides 188, 190 help to align the pad holders 160 with the cleaning pads 30, and by pressing downwardly on the mop 10 the cleaning pads 30 are pressed against the hook and loop pad fasteners 166 to transfer the pads 30 to the mop 10. The mop 10 can then be lifted away from the tray 186, with the cleaning pads 30 secured to the base 14.

There are several advantages of the present disclosure arising from the various features of the apparatus described herein. For example, the examples of the present disclosure described above provide a mop 10 having rotating cleaning pads 30 with an alignment jig 168, 176, 184 for mounting the cleaning pads 30 precisely and accurately on the mop 10. Mounting the cleaning pads 30 precisely on the pad holders 160 presents a challenge because of the position of the pad holders 160 on the underside of the base 14. Incorrect alignment between the pads 30 and pad holders 160 can cause an unbalanced feeling and/or vibration in the hand grip 24 during use. To resolve this issue, a pad alignment jig 168, 176, 184 can be provided and used to either align the pad 30 with the pad holders 160 or vice versa for correct alignment, which can result in a more comfortable feel during operation of the mop 10.

Another advantage arising from the various features of the apparatus described herein is that an auxiliary scrubber 38 in the form of a flip-down agitator may be provided in addition to the counter-rotating cleaning pads 30. The scrubber 38 can be selectively used to provide an enhanced, localized scrubbing of the surface to be cleaned in conjunction with the agitation provided on by the cleaning pads 30 or alone.

Yet another advantage arising from the various features of the apparatus described herein is that a lock-out mechanism 104 is provided for a multi-axis swivel joint 76 so that one of the axes may be selectively locked out. With respect to the illustrated example having counter-rotating cleaning pads 30, locking out the side-to-side pivot makes it easier for a user to maneuver and control the base 14, as the counter-rotating pads 30 cause the mop to "glide" over the surface during operation.

While various examples illustrated herein show an upright, fluid-dispensing floor mop 10, aspects of the present disclosure may be used on other types of floor cleaners, including, but not limited to, a canister device having a cleaning implement connected to a wheeled base by a hose, a portable cleaner adapted to be hand carried by a user for cleaning relatively small areas, an autonomous robot cleaner, or a mop without a fluid delivery system. Further, aspects of the present disclosure may also be used on surface cleaning apparatus other than a wet mop, such as an extraction cleaner, steam cleaner or a vacuum cleaner. A steam cleaner generates steam by heating water to boiling for delivery to the surface to be cleaned, either directly or via cleaning pad. Some steam cleaners collect liquid in the pad, or may extract liquid using suction force. A vacuum cleaner typically does not deliver or extract liquid, but rather is used for collecting relatively dry debris (which may include dirt, dust, stains, soil, hair, and other debris) from a surface. Still further, aspects of the present disclosure may also be used on non-motorized mops, such as those having one or more stationary cleaning pads.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A floor cleaning apparatus, comprising:

a housing;

a motorized agitation system operably coupled to the housing, the motorized agitation system comprising:

a plurality of rotatable pad holders provided on the housing;

a plurality of cleaning pads, wherein one of the plurality of cleaning pads is provided on each of the plurality of rotatable pad holders for rotation therewith; and at least one drive motor operably coupled with the plurality of rotatable pad holders for rotation of the plurality of rotatable pad holders and the plurality of cleaning pads; and at least one removable pad alignment jig for simultaneously mounting the plurality of cleaning pads on the plurality of rotatable pad holders.

2. The floor cleaning apparatus of claim 1 wherein the at least one removable pad alignment jig is removed prior to cleaning a floor surface.

3. The floor cleaning apparatus of claim 1 wherein the plurality of cleaning pads are rotatable about a substantially vertical axes of rotation that are laterally spaced from each other.

4. The floor cleaning apparatus of claim 3 wherein the at least one removable pad alignment jig comprises a tool that connects the plurality of cleaning pads to the plurality of rotatable pad holders in proper spacing.

5. The floor cleaning apparatus of claim 4 wherein the at least one removable pad alignment jig comprises two arcuate retainers adapted for the plurality of cleaning pads and a grip.

6. The floor cleaning apparatus of claim 4 wherein the at least one removable pad alignment jig is a rule-type tool having receivers adapted to fit at least partially around the plurality of rotatable pad holders and a grip located between the receivers.

7. The floor cleaning apparatus of claim 4 wherein the at least one removable pad alignment jig is formed as a tray that can selectively receive at least a portion of the housing.

8. The floor cleaning apparatus of claim 7 wherein the tray includes guides adapted for receiving the plurality of cleaning pads and a set of depressions in alignment with the plurality of rotatable pad holders.

9. The floor cleaning apparatus of claim 4 wherein mounting of the plurality of cleaning pads onto the plurality of rotatable pad holders with the at least one removable pad alignment jig limits vibration within the housing during operation of the floor cleaning apparatus as compared to without use of the at least one removable pad alignment jig.

10. The floor cleaning apparatus of claim 1 wherein the floor cleaning apparatus is a motorized floor mop.

11. The floor cleaning apparatus of claim 10 wherein the housing comprises a base operably coupled to a handle.

12. The floor cleaning apparatus of claim 11, further comprising a multi-axis swivel joint coupling the handle with the base for movement of the handle about a first axis of rotation and a second axis of rotation that is orthogonal to the first axis of rotation.

13. The floor cleaning apparatus of claim 12, further comprising a fluid delivery system operably coupled to the housing and comprising a supply tank and a fluid distributor in fluid communication with the supply tank via a fluid delivery pathway.

14. The floor cleaning apparatus of claim 13 wherein the handle supports the supply tank, the fluid distributor is provided on the base, and the fluid delivery pathway extends at least partially through the multi-axis swivel joint.

15. The floor cleaning apparatus of claim 14 wherein the fluid delivery pathway comprises at least one flexible conduit extending through the multi-axis swivel joint.

16. The floor cleaning apparatus of claim 13 wherein the fluid distributor is provided on the base and comprises at least one distributor outlet configured to spray fluid outwardly in front of the base, forward of the plurality of cleaning pads.

17. The floor cleaning apparatus of claim 13 wherein the fluid delivery system comprises a flow control system configured to control a flow of fluid from the supply tank to the fluid distributor.

18. The floor cleaning apparatus of claim 17, further comprising a first actuator provided on the handle for selective actuation of the fluid delivery system and operably coupled to the flow control system and a second actuator provided on the handle for selective actuation of the motorized agitation system and operably coupled to the drive motor.

19. The floor cleaning apparatus of claim 1 wherein the at least one drive motor comprises a single drive motor operably coupled with each of the plurality of cleaning pads.

20. The floor cleaning apparatus of claim 1, further comprising an auxiliary scrubber provided on the housing, separate from the plurality of cleaning pads, wherein the auxiliary scrubber comprises a flip-down agitator provided at a rear side of the housing and configured for movement between a first use position and a second non-use position.

* * * * *